United States Patent [19]

Coffin et al.

[11] 4,120,697

[45] Oct. 17, 1978

[54] SEGREGATION-SEPARATION OF COPPER FROM NICKEL IN COPPER-NICKEL SULFIDE CONCENTRATES

[75] Inventors: Lamar D. Coffin, Edison; William R. Opie, Holmdel, both of N.J.

[73] Assignee: Amax Inc., Greenwich, Conn.

[21] Appl. No.: 787,786

[22] Filed: Apr. 15, 1977

[51] Int. Cl.[2] ..... C22B 15/00

[52] U.S. Cl. ..... 75/72; 75/7; 75/21; 75/82; 75/117

[58] Field of Search ..... 75/2, 7, 9, 21, 26, 75/63, 72, 82, 117

[56] References Cited

U.S. PATENT DOCUMENTS

| | | | |
|---|---|---|---|
| 1,865,153 | 6/1932 | Taplin | 75/72 |
| 2,425,760 | 8/1947 | Sproule et al. | 75/21 |
| 3,453,101 | 7/1969 | Takahashi et al. | 75/2 |
| 3,799,764 | 3/1974 | Opie et al. | 75/72 |
| 3,871,867 | 3/1975 | Last et al. | 75/2 |

*Primary Examiner*—M. J. Andrews

*Attorney, Agent, or Firm*—Michael A. Ciomek

[57] ABSTRACT

Copper is separately recovered from at least one nickeliferous sulfidic material selected from the group consisting of ore, ore concentrates, mattes or other metallurgical intermediates by roasting the sulfidic material to produce a calcine, mixing the calcine with a particulate carbonaceous reductant and with at least one halide heat transformable to halogen or to hydrogen halide at a segregation roasting temperature in small but effective amounts to halogenate copper values contained in the calcine, heating the mixture to a segregation roasting temperature between about 650° C and about 700° C whereby copper values contained in the calcine react to form a halide which is transported as a halide to the particulate carbonaceous reductant and metallic copper is precipitated from the copper halide on the surface of the carbonaceous reductant. The precipitated metallic copper is recovered as a highly enriched concentrate containing at least about 90% of the copper contained in the starting sulfidic material.

12 Claims, No Drawings

SEGREGATION-SEPARATION OF COPPER FROM NICKEL IN COPPER-NICKEL SULFIDE CONCENTRATES

BACKGROUND OF THE INVENTION

The present invention relates to the separation of copper from nickeliferous sulfidic materials and, more particularly, to a pyrometallurgical process for separating copper from nickeliferous sulfidic ores, ore concentrates, mattes, or other metallurgical intermediates.

Copper is nearly always co-present in nickeliferous sulfide ores and nickel is frequently present in minor amounts in cuperiferous sulfidic ores. The cuperiferous and nickeliferous pyrrhotitic ores found in the northern United States, Canada, southern Africa and the USSR are examples of such ores in which copper and nickel are co-present.

After being mined, sulfidic ores are commonly crushed, ground and subjected to a bulk flotation treatment to separate the gangue from the mineral values. Typically, bulk concentrates can contain between about 5% and about 20% copper and between about 2% and about 10% nickel with the two metals being present in a wide range of ratios. The separation of copper from nickel in these concentrates has been the focus of extractive metallurgists over the years.

Copper and nickel values contained in pyrrhotitic ore concentrates have been separated in any one of a number of ways. All these processes, however, begin with the smelting of the concentrate, either in a blast furnace or in a reverbatory furnace. The literature contains many references to processes actually used to separate copper and nickel values contained in matte produced by matte smelting. All these methods are described in considerable detail, for example, in the book "The Winning of Nickel" by J. R. Boldt, Jr., VanNostrand, New York, 1967.

Both pyrometallurgical and hydrometallurgical approaches have been used. Among the former group is the old (and now obsolete) Orford process in which the copper-nickel conversion matte obtained after iron removal by slagging is smelted with sodium sulfide to generate a sodium copper sulfide liquid phase that is immiscible in liquid nickel sulfide and forms a top sodium-copper sulfide liquid layer. After solidification, the two layers are mechanically separated and individually treated for recovery of copper and nickel.

Another pyrometallurgical method involves controlled slow cooling of the matte which promotes the formation of discreet particles of nickel sulfide, copper sulfide and a metallic fraction within the slowly cooled matte. These products are then recovered by a combination of crushing, grinding, flotation and magnetic separation.

Still another pyrometallurgical method of separating nickel and copper in converter matte (especially where the nickel to copper ratio is low) is to overblow the matte beyond the point of iron removal. Nickel is preferentially oxidized by this treatment and the comparatively low chemical potential of nickel in the overlying slag results in the selective removal of nickel values from the copper phase into the slag phase. If nickel recovery is intended, this slag must be subsequently treated, as by leaching or by energetic electric furnace reduction processing.

Hydrometallurgy applied to copper-nickel matte is also commercially used for separating copper and nickel in these materials. Nickel values can be recovered separately from the matte by controlled oxidative leaching, or copper can be recovered by roasting the matte and leaching with acid whereby copper values are selectively dissolved from the roasted matte.

As is clearly evident from the above, none of the conventional practices has to this time succeeded in providing an economical, simple process for separating nickel and copper combined in complex copper-nickel ores prior to the point where the concentrate containing copper and nickel has been smelted to a matte. This entails some significant disadvantages. The further pyrometallurgical treatment of matte beyond the smelting stage produces secondary sources of sulfur dioxide including fugitive emissions. These are known to be costly, if not impossible, to control. The hydrometallurgical treatment of mattes can also involve a secondary sulfur disposal problem if the matte is roasted prior to leaching. If matte is not roasted prior to leaching, that is, if it is leached directly, the further separation of the sulfides involves a complicated series of selective leaching steps that are, at the very least, expensive to carry out and require a high degree of control.

BRIEF DESCRIPTION OF THE INVENTION

Briefly stated, the present invention comprises generally a process for separately recovering a high grade copper concentrate from at least one nickeliferous sulfidic material selected from the group consisting of ore, ore concentrates, mattes or other metallurgical intermediates. The process comprises roasting the sulfidic material to produce a calcine, mixing the calcine with a particulate, carbonaceous reductant and with at least one halide salt, which is heat transformable to a gaseous halogen or to a hydrogen halide at a segregation roasting temperature, in small but effective amounts to halogenate copper values contained in the calcine, heating the mixture to a segregation roasting temperature between about 650° C. and about 700° C. at which temperature copper values in the calcine react to form a copper halide which is transported to the particulate carbonaceous reductant where metallic copper is precipitated on the carbonaceous reductant from the copper halide, and the precipitated metallic copper is recovered. Conventional separation techniques, such as gravity separation or flotation, can be employed to provide a highly enriched copper concentrate containing at least 90% of the copper.

The highly enriched copper concentrate produced by the process in accordance with the present invention contains only minor amounts of nickel and residual amounts of unused reductant. The reductant can be easily separated from the copper concentrate by melting the copper concentrate whereby unused reductant floats to the surface of the copper bath. Any copper oxide formed upon cooling and subsequent processing to produce the highly enriched copper concentrate will be reduced by the residual reductant. The molten copper generally analyzes at least about 95% copper (advantageously at least about 97%) and contains substantially all the precious metals in the ore. The molten copper can be cast into anodes for subsequent electrorefining.

DETAILED DESCRIPTION

The process in accordance with the present invention can be used to separate copper from all nickeliferous sulfidic materials. Such sulfidic materials include ores, ore concentrates, mattes and other metallurgical intermediates. The term "metallurgical intermediates" includes sulfide precipitates obtained from hydrometallurgical processes, residues obtained from electrorefining and sulfide residues obtained from vapometallurgical operations.

Sulfidic materials that can be treated by the process in accordance with the present invention contain between about 5% and about 40% copper (preferably between about 5% and about 20%), nickel between about 1% and about 35% (preferably between about 3% and about 15%), iron between about 1% and about 35% (preferably between about 25% and about 35%), and sulfur between about 6% and about 35% (preferably between about 20% and about 30%), and the balance gangue material or slag. In addition to the foregoing ingredients the sulfidic materials can contain minor amounts of selenium, tellurium, lead, zinc, precious metals including gold, silver, platinum, palladium and the like.

If the sulfidic material is not in particulate from e.g. at least about 60% minus 200 mesh (U.S. Standard Screen Size) and preferably at least about 80% minus 200 mesh, the sulfidic material is comminuted to provide a particle size distribution of at least about 60% minus 200 mesh, advantageously at least about 80% minus 200 mesh. Sulfidic material having the foregoing particle size distribution insures good gas-solid contact in the various stages of processing while minimizing the problems associated with dusting and agglomeration.

The particulate sulfidic material is roasted to form a calcine. Roasting can be conducted in conventional apparatus, such as multihearth roasting furnaces equipped with rotating rabble arms or fluid bed reactors. Regardless of the type of apparatus employed for the roasting operation, the sulfidic material is advantageously dead roasted, i.e. roasted to a sulfur content of less than about 2% and preferably less than about 0.5%, at a temperature between about 750° C. and about 950° C., advantageously between about 800° C. and about 850° C.

Dead roasting copper-and-nickel-containing sulfidic materials to sulfur contents and at temperatures within the foregoing ranges produces a calcine that can be readily treated for the separate recovery of copper as a highly enriched metallic copper concentrate. Roasting at temperatures above about 900° C. can render the copper values in a calcine less reactive by the formation of cuperiferous ferrites thereby lowering copper recoveries. If the sulfidic material is not dead roasted to the foregoing sulfur levels, a lower grade copper concentrate is produced and lower copper recoveries are realized. Therefore, the sulfidic material is advantageously dead roasted to a sulfur content below about 1% at a temperature between about 800° C. to provide a calcine from which copper can be selectively recovered at recovery rates exceeding at least about 90% of the copper contained in the starting sulfidic material.

Copper is selectively recovered from the calcine by heating a mixture of the calcine, at least one halide heat transformable at a segregation roasting temperature to a halogen or to a hydrogen halide and a particulate carbonaceous reductant to a segregation roasting temperature between about 650° C. and about 700° C. Examples of halides heat transformable to a halogen or a hydrogen halide at the segregation roasting temperatures are the alkali metal halides, such as sodium chloride, potassium chloride, lithium chloride, sodium iodide, potassium iodide, lithium iodide, sodium bromide, potassium bromide, and lithium bromide, and alkaline earth metal halides, such as calcium chloride, magnesium chloride, calcium iodide, magnesium iodide, and calcium bromide. The halides are added to the calcine in small but effective amounts to halogenate the copper values contained in the calcine. In most instances, halide additions between about 0.5% and about 1.0%, based on the weight of the calcine, and advantageously between about 0.5% and about 1.0%, are adequate to insure substantially complete halogenation of the copper values contained in the calcine while minimizing reagent costs. From the viewpoint of process effectiveness and cost, sodium chloride is advantageously added to the calcine as the halide salt.

A solid carbonaceous reductant is also incorporated in the calcine before heating to the segregation roasting temperature. The carbonaceous reductant is added in particulate form having a particle size distribution of at least about 100% minus 60 mesh. The amount of carbonaceous reductant added to the calcine is correlated to the copper content. In most instances, the particulate carbonaceous reductant is added to the calcine in amounts between about 5.0% and about 12.0%, based on the weight of the calcine, advantageously in amounts between about 5.0% and about 8.0%, i.e. between about 1.3 moles and about 1.6 moles of carbon for each mole copper. Examples of carbonaceous reductants that can be employed include coke, charcoal, coal and sawdust.

The mixture of calcine, halide and solid carbonaceous reductant is heated to a segregation roasting temperature between about 625° C. and about 725° C. and advantageously to a temperature between about 650° C. and about 675° C., to halogenate copper values contained in the calcine which halogenated copper values are vapor transported to the solid carbonaceous reductant where the halogenated copper values are reduced and precipitated as metallic copper. At these temperatures, surprisingly small amounts of nickel halides are formed and transported to the solid carbonaceous reductant, which nickel halides if formed and transported would be reduced and precipitated as metallic nickel along with the copper values. Only within the narrow temperature range between about 625° C. and about 725° C. are copper halides substantially completely and exclusively formed, transported and reduced to precipitate metallic copper on the carbonaceous reductant. At lower temperatures, the selectivity of the formation of copper halides and the precipitation of metallic copper on the particulate reductant remains exceptionally high. However, copper recoveries rapidly fall with decreasing segregation roasting temperatures to commercially unacceptable levels. At segregation roasting temperatures exceeding about 800° C. both selectively and copper recovery diminish rapidly. Therefore, in order to realize copper recoveries of at least about 90% and to produce highly enriched copper concentrates containing at least about 75% copper the segregation roast is conducted at a temperature between about 625° C. and about 725° C.

The calcine mixture is held at the segregation roast temperature long enough to assure that at least about 90% of the copper contained in a calcine is halogenated, transported to the particulate reductant and precipitated on the surface thereof. The temperature at which the reaction is conducted plays an important role in determining the length of time the calcine mixture is held at the segregation roasting temperature. At the higher segregation roasting temperatures, shorter segregation times are required, as both the chemical reactions and the transport mechanisms occur more rapidly at the higher temperatures. Generally, reaction times between about 3 hours and about 6 hours, advantageously between about 4 hours and 6 hours, are sufficient to insure substantially complete segregation of the copper values at the lower end of the segregation roast temperature range while reaction times between about 2 hours and about 4 hours, advantageously between about 3 hours and about 4 hours, are sufficient to insure substantially complete segregation of the copper values at the higher end of the segregation roasting temperature range. Segregation of copper during the segregation roast is dependent partially upon kinetics and if the calcine mixture is held at too high a temperature too long, other metal values such as nickel and/or iron can be halogenated, transported and precipitated on the surface of the particulate reductant thereby lowering the selectivity of the segregation roast. Moreover, copper precipitated on the particulate reductant can diffuse back to the bulk of calcine having the twofold effect of lowering selectivity and lowering copper recovery. Therefore, when high selectivity and high copper recoveries are sought, the segregation roasting temperatures and the segregation times described hereinabove are employed.

When the segregation roast is completed, the calcine mixture is rapidly cooled to ambient temperatures to minimize oxidation of the segregated copper values. Advantageously, the hot calcine is rapidly cooled by quenching.

Although the segregated copper values can be separated from the bulk of the calcine, by any well-known means, such as heavy media separation techniques or by magnetic separation if the calcine contains substantial amounts of iron oxides that had been reduced to magnetite during the segregation roast, it is advantageous to separate segregated copper values from the bulk of the calcine material by froth flotation techniques. In order to increase the effectiveness of the flotation process, the cooled calcine is advantageously comminuted or ground to flotation fineness i.e. at least about 60% minus 200 mesh. Even if the sulfidic material was ground to this particle size distribution and/or the calcine derived from the roasting operation possessed this particle size distribution, it is advantageous to subject the segregation roasted calcine mixture to attrition to liberate segregated copper values trapped in agglomerates formed by sintering during the segregation roast.

The ground and segregation roasted calcine can then be pulped with water to provide a slurry containing between about 14% and about 30% solids. The pH value of the slurry is adjusted to a value between about 7 and about 10 by the addition of controlled amounts of calcined limestone thereto and then frothers, collectors, activators, and depressants can be added to the slurry to improve the separation of the segregated copper values from the bulk of the calcine material by froth flotation.

The first stage flotation step produces a rougher concentrate and rougher tailings. The rougher tailings can be suitably treated to recover nickel values and residual copper values contained therein or sent to waste while the rougher concentrate can be treated by additional flotation steps to produce a cleaned concentrate which can be melted and cast into anodes and cleaner tailings which can be recycled to various stages of the overall process to recover copper values contained therein. Recycle of the cleaner tailings (middlings) to the desulfurizing roast is particularly advantageous in that copper recovery in the cleaner concentrate and nickel recovery in rougher tailings are markedly improved as shown in Example III.

An advantageous embodiment of the present invention is the addition of controlled amounts of moisture to the atmosphere above the mixture of the calcine, halide and particulate reductant during the segregation roast. When the segregation roast is conducted in a closed furnace on a batch basis beneficial effects of water vapor can be realized by providing the furnace with a carbon monoxide atmosphere saturated with water vapor. When segregation roasting is conducted on a continuous basis such as in a countercurrently fired rotary furnace the combustion of hydrocarbon fuels supplied sufficient water vapor or realize the beneficial effects associated therewith.

Another advantageous feature of the present invention is the addition of controlled amounts of silica to the mixture of calcine, halide and particulant reductant. The addition of controlled amounts of silica to the calcine mixture enhances both the selectivity and recovery of copper values contained in a calcine. The advantageous effects contributed by the addition of silica can be realized by adding between about 5% and about 10% silica, based on the weight of the calcine, to the mixture.

In order to give those skilled in the art an appreciation of the advantages flowing from the use of the process in accordance with the present invention, the following illustrative examples are given:

EXAMPLE I

A copper nickel sulfide bulk flotation concentrate containing 13.5% copper and 2.7% nickel was dead roasted at a temperature of about 850° C. to produce a calcine containing 0.2% sulfur.

Samples of the calcine were mixed with 5% minus 200 mesh metallurgical coke and 0.5% sodium chloride and charged into a fused quartz retort. Each sample was heated to a segregation roasting temperature ranging from 825° C. down to 625° C. The samples for tests 3 through 5 were held at the segregation roasting temperature for 6 hours while the sample for test 1 was held at 825° C. for 2 hours and the sample for test 2 was held at the segregation roasting temperature of 725° C. for 3 hours.

The results of these tests are reported in Table 1 which results confirm that at temperatures above about 800° C. both selectivity and recovery of copper in the calcine are quite low. Tests 2 and 3 demonstrate that at high segregation roasting temperatures of 725° C. longer reaction times lower both copper recovery and selectivity. The results of test 4 indicate that a segregation roasting time of 6 hours at 675° C. provides both excellent copper recovery and selectivity. The effects of low segregation roasting temperatures are shown by the results of test 5 in which the selectivity remains very high but copper recovery is quite low.

In addition to the above described tests, four additional tests were conducted in which silica in amount of 10%, by weight, was added to the calcine mixtures in tests 6, 7 and 9 and 5% in test 8. These mixtures were charged to quartz retorts which were provided with moisturized carbon monoxide atmospheres. The retorts were placed in a muffle and heated to various temperatures, 675° C. for tests 6 through 8 and 625° C. for test 9 for segregation roasting times shown in Table 1.

TABLE 1

| Test No. | Time Hr. | Temp C | % Coke | % NaCl | % $SiO_2$ | Flotation Products | % Assay % Wt | Cu | Ni | % Distribution Cu | Ni |
|---|---|---|---|---|---|---|---|---|---|---|---|
| 1 | 2 | 825 | 5.0 | 0.5 | 0 | Cleaned Concentrate | 9.4 | 72.64 | 6.57 | 48.5 | 22.5 |
| | | | | | | Cleaner Tailings | 13.1 | 28.90 | 5.95 | 26.5 | 28.2 |
| | | | | | | Rougher Tailings | 77.5 | 4.52 | 1.76 | 24.7 | 49.3 |
| 2 | 3 | 725 | 5.0 | 0.5 | 0 | Cleaned Concentrate | 13.5 | 79.60 | 0.75 | 76.3 | 3.8 |
| | | | | | | Cleaner Tailings | 8.1 | 25.90 | 1.94 | 14.8 | 5.8 |
| | | | | | | Rougher Tailings | 78.4 | 1.59 | 3.14 | 8.9 | 90.4 |
| 3 | 6 | 725 | 5.0 | 0.5 | 0 | Cleaned Concentrate | 12.1 | 77.10 | 1.90 | 68.9 | 8.7 |
| | | | | | | Cleaner Tailings | 10.8 | 26.50 | 3.80 | 20.9 | 15.3 |
| | | | | | | Rougher Tailings | 77.1 | 1.80 | 2.60 | 10.2 | 76.0 |
| 4 | 6 | 675 | 5.0 | 0.5 | 0 | Cleaned Concentrate | 13.8 | 79.93 | 0.13 | 80.0 | 0.7 |
| | | | | | | Cleaner Tailings | 7.2 | 28.10 | 1.37 | 14.8 | 3.8 |
| | | | | | | Rougher Tailings | 79.0 | 0.90 | 3.24 | 5.2 | 95.5 |
| 5 | 6 | 625 | 5.0 | 0.5 | 0 | Cleaned Concentrate | 11.7 | 74.89 | 0.026 | 63.7 | 0.2 |
| | | | | | | Cleaner Tailings | 10.3 | 28.10 | 1.18 | 20.9 | 5.9 |
| | | | | | | Rougher Tailings | 78.0 | 2.72 | 2.45 | 15.4 | 93.9 |
| 6 | 2 | 675 | 5.0 | 0.5 | 10.0 | Cleaned Concentrate | 12.3 | 74.91 | 0.034 | 73.7 | 0.2 |
| | | (Moisturized CO Atmosphere) | | | | Cleaner Tailings | 9.5 | 21.90 | 2.36 | 16.8 | 9.8 |
| | | | | | | Rougher Tailings | 78.2 | 1.52 | 2.64 | 9.5 | 90.0 |
| 7 | 3 | 675 | 5.0 | 0.5 | 10.0 | Cleaned Concentrate | 13.6 | 71.40 | 0.03 | 82.7 | 0.1 |
| | | (Moisturized CO Atmosphere) | | | | Cleaner Tailings | 6.1 | 25.50 | 1.96 | 13.2 | 5.1 |
| | | | | | | Rougher Tailings | 80.3 | 0.60 | 2.80 | 4.1 | 94.8 |
| 8 | 3 | 675 | 5.0 | 0.5 | 5.0 | Cleaned Concentrate | 12.8 | 77.66 | 0.027 | 77.0 | 0.1 |
| | | (Moisturized CO Atmosphere) | | | | Cleaner Tailings | 7.6 | 30.00 | 1.84 | 17.9 | 5.7 |
| | | | | | | Rougher Tailings | 79.6 | 0.82 | 2.92 | 5.1 | 94.2 |
| 9 | 6 | 625 | 5.0 | 0.5 | 10.0 | Cleaned Concentrate | 12.1 | 75.90 | 0.03 | 73.0 | 0.2 |
| | | (Moisturized CO Atmosphere) | | | | Cleaner Tailings | 9.8 | 26.10 | 2.20 | 20.7 | 8.7 |
| | | | | | | Rougher Tailings | 78.1 | 1.00 | 2.90 | 6.3 | 91.1 |

The results shown for tests 7 and 8 confirm that the combination of moisture and silica greatly enhances the reactions occurring in the segregation roast. These tests show that the addition of silica and moisture can lower reaction times by as much as 50% while increasing copper recovery without significantly lowering the selectivity with the segregation process. Comparison of tests 5 and 9 further demonstrates that silica and moisture additions can improve copper recovery without significantly lowering the selectivity for calcine mixtures segregation roasted at 625° C.

EXAMPLE II

Another copper nickel bulk flotation concentrate containing 4.5% copper and 3.1% nickel was dead roasted at a temperature of 850° C. to produce a calcine having a sulfur content of 0.2% sulfur.

Two samples of the calcine were mixed with 5% coke and 0.5% sodium chloride, both by weight.

One sample was placed in a fused quartz retort which was heated in a muffle furnace to a segregation roasting temperature of 825° C. for 4 hours. The other sample was placed in a fused quartz retort and heated in a muffle furnace to a temperature of 675° C. for 6 hours. The results of these tests are reported in Table II.

The data shown in Table II again confirm that copper recoveries and the selectivity of the segregation process are lost at high temperatures. The data of the 675° C. segregation roast show copper recoveries in excess of 80% with good selectivity can be obtained by practice of the present invention.

EXAMPLE III

A copper nickel bulk flotation sulfide concentrate containing 13.5% copper and 2.7% nickel was dead roasted at 850° C. to a sulfur content of 0.2%.

TABLE II

| Test Conditions Time hr | Temp C | % Coke | % naCl | % $SiO_2$ | Flotation Products | % Assay % Wt | Cu | Ni | % Distribution Cu | Ni |
|---|---|---|---|---|---|---|---|---|---|---|
| 4 | 825 | 5.0 | 0.5 | 0 | Cleaned Concentrate | 7.9 | 36.1 | 15.86 | 47.3 | 40.7 |
| | | | | | Cleaner Tailings | 3.6 | 12.9 | 8.45 | 7.7 | 9.8 |
| | | | | | Rougher Tailings | 88.5 | 3.05 | 1.71 | 45.0 | 49.5 |
| 6 | 675 | 5.0 | 0.5 | 0 | Cleaned Concentrate | 8.6 | 48.7 | 1.44 | 85.4 | 4.5 |
| | | | | | Cleaner Tailings | 2.0 | 4.77 | 2.51 | 1.9 | 1.8 |
| | | | | | Rougher Tailings | 89.4 | 0.69 | 2.85 | 12.7 | 93.7 |

Initially, a sample of the roasted concentrate was mixed with 5.0% coke and 0.5% sodium chloride. The mixture was placed in a fused quartz retort which was heated in a muffle furnace. The mixture was heated to a temperature of 675° C. for 4 hours.

The segregation roasted material was cooled, ground, pulped with water and then subjected to froth flotation to provide a cleaned concentrate, cleaner tailings and rougher tailings. The cleaner concentrate was reserved for copper recovery and the tailings were reserved for nickel recovery. The cleaner tailings were recycled to another charge of sulfide concentrate, prior to roasting, for retreatment.

Recycling of the cleaner tailings to the desulfurizing roast was repeated six times. The weight distribution of the flotation products, the assays of the flotation products and the distribution of the copper and nickel values in the flotation products are given in Table III. It should be noted that Flotation Stage 1 Table III refers to the initial sample without any recycle.

The reserved flotation products were combined to provide composite flotation products having the weight distribution and the nickel and copper distribution shown in Table IV. The results in Table IV which would simulate continuous plant operation show that over 92% of the copper is recovered in the cleaned concentrate and that over 98% of the nickel reports in the rougher tailings.

The composite cleaned concentrate was melted without fire refining to separate the unused coke from the concentrate. The melt was cast and chemically analyzed.

TABLE III

Metallurgical Results - Locked Flotation of Segregated Bagdad-Pikwe Concentrate Blend

| Flotation Stage | Flotation Products | % Wt | % Assay Cu | % Assay Ni | % Distrib. Cu | % Distrib. Ni |
|---|---|---|---|---|---|---|
| 1 | Cleaned Concentrate | 13.5 | 76.0 | 0.04 | 84.1 | 0.3 |
| | Cleaner Tailings | 7.3 | 18.3 | 2.60 | 10.9 | 9.4 |
| | Rougher Tailings | 79.2 | 0.77 | 2.30 | 5.0 | 90.3 |
| 2 | Cleaned Concentrate | 13.9 | 76.2 | 0.03 | 84.9 | 0.2 |
| | Cleaner Tailings | 7.3 | 17.5 | 2.60 | 10.3 | 6.6 |
| | Rougher Tailings | 78.8 | 0.78 | 2.36 | 5.0 | 90.6 |
| 3 | Cleaned Concentrate | 13.7 | 74.7 | 0.04 | 84.4 | 0.3 |
| | Cleaner Tailings | 6.3 | 20.4 | 2.50 | 10.7 | 7.9 |
| | Rougher Tailings | 80.0 | 0.75 | 2.30 | 4.9 | 91.8 |
| 4 | Cleaned Concentrate | 13.5 | 76.3 | 0.04 | 82.7 | 0.3 |
| | Cleaner Tailings | 7.2 | 19.0 | 2.40 | 11.0 | 8.2 |
| | Rougher Tailings | 79.3 | 0.98 | 2.42 | 6.3 | 91.5 |
| 5 | Cleaned Concentrate | 13.0 | 75.3 | 0.05 | 79.4 | 0.3 |
| | Cleaner Tailings | 8.2 | 23.2 | 2.30 | 15.5 | 9.4 |
| | Rougher Tailings | 78.8 | 0.80 | 2.32 | 5.1 | 90.3 |
| 6 | Cleaned Concentrate | 14.0 | 75.3 | 0.05 | 81.9 | 0.3 |
| | Cleaner Tailings | 8.3 | 18.6 | 2.60 | 12.0 | 10.4 |
| | Rougher Tailings | 77.7 | 1.01 | 2.40 | 6.1 | 89.3 |
| 7 | Cleaned Concentrate | 13.4 | 75.8 | 0.05 | 83.0 | 0.3 |
| | Cleaner Tailings | 8.7 | 16.5 | 2.60 | 9.5 | 8.9 |
| | Rougher Tailings | 77.9 | 1.18 | 2.38 | 7.5 | 90.8 |

TABLE IV

Composite Flotation Products - Copper and Nickel Distribution After Six Recycles

| | % Wt | Copper % Distribution | Nickel % Distribution |
|---|---|---|---|
| Cleaned Concentrate | 14.52 | 92.16 | 0.31 |
| Cleaner Tailings | 1.08 | 1.49 | 1.39 |
| Rougher Tailings | 84.40 | 6.35 | 98.30 |

The cast copper had the following grade: Cu, 98.0%; Fe, 0.74%; Ni, 0.05%.

Although the present invention has been described in conjunction with preferred embodiments, it is to be understood that modifications and variations may be resorted to without departing from the principles and scope of the invention as those skilled in the art will readily understand. Such modifications and variations are considered to be within the purview and scope of the invention and the appended claims.

We claim:

1. The process for separating copper values from at least one nickeliferous sulfidic material selected from the group consisting of ore, ore concentrates, mattes, or other metallurgical intermediates which comprises roasting the sulfidic material to produce a calcine, mixing the calcine with at least one halide salt heat transformable to a halogen or hydrogen halide at a segregation roasting temperature in small but effective amounts to halogenate copper values contained in the calcine and a particulate carbonaceous reductant, heating the mixture to a segregation roasting temperature between about 625° C. and 725° C. whereby copper values contained in the calcine are halogenated, transported to the carbonaceous reductant and precipitated as metallic copper on the carbonaceous reductant, cooling the heated calcine mixture and separately recovering the metallic copper precipitate which has a copper to nickel ratio of at least eight times that of the sulfidic material.

2. The process as described in claim 1 wherein the nickeliferous sulfidic material is dead roasted to a sulfur content of less than about 1%.

3. The process as described in claim 2 wherein the halide salt is sodium chloride.

4. The process as described in claim 3 wherein the sodium chloride is added to the calcine in an amount between about 0.3% and about 0.5%.

5. The process as described in claim 4 wherein the carbonaceous reductant is added to the calcine in an amount between about 1.3 and 1.6 moles of carbon/per mole of copper.

6. The process as described in claim 5 wherein silica is added to the calcine to enhance the selectivity and recovery of copper.

7. The process as described in claim 6 wherein silica is added in amounts between about 5% and about 10%.

8. The process as described in claim 5 wherein the atmosphere above the calcine during the segregation roast contains moisture.

9. The process as described in claim 1 wherein the calcine is dead roasted to a sulfur content of less than about 0.5% at a temperature below about 850° C.

10. The process as described in claim 1 wherein the precipitated metallic copper is recovered by froth flotation.

11. The process as described in claim 10 wherein the first froth flotation provides a bulk flotation concentrate and tails and the bulk flotation concentrate is subjected to a second froth flotation treatment to provide a cleaned concentrate from which copper is recovered and a cleaner tailings which is recycled to the sulfidic material prior to roasting.

12. The process for separating copper values from at least one nickeliferous sulfidic material selected from the group consisting of ore, ore concentrates, mattes, or other metallurgical intermediates which comprises roasting the sulfidic material to produce a calcine containing less than about 1% sulfur, mixing the calcine with sodium chloride in an amount between about 0.3% and about 0.5% and a particulate carbonaceous reductant in an amount between about 1.3 and about 1.6 moles of carbon per mole of copper, heating the mixture to a segregation roasting temperature between about 625° C. and 725° C. whereby copper values contained in the calcine are chlorinated, transported to the carbonaceous reductant and precipitated as metallic copper on the carbonaceous reductant, cooling the heating calcine mixture and separately recovering the metallic copper precipitate which has a copper to nickel ratio of at least eight times that of the sulfidic material.

* * * * *